US007908114B2

(12) United States Patent
Ruggiero

(10) Patent No.: US 7,908,114 B2
(45) Date of Patent: Mar. 15, 2011

(54) SYSTEM AND METHOD FOR ALIGNING A RAILROAD SIGNALING SYSTEM

(75) Inventor: Andrew Lawrence Ruggiero, Lee's Summit, MO (US)

(73) Assignee: General Electric Company, Schenectady, NY (US)

( * ) Notice: Subject to any disclaimer, the term of this patent is extended or adjusted under 35 U.S.C. 154(b) by 598 days.

(21) Appl. No.: 11/748,549

(22) Filed: May 15, 2007

(65) Prior Publication Data

US 2008/0288170 A1 Nov. 20, 2008

(51) Int. Cl.
*G01C 9/00* (2006.01)
*G05D 3/00* (2006.01)
*B61L 29/30* (2006.01)

(52) U.S. Cl. ..... 702/151; 702/85; 702/92; 246/473 R; 700/56; 700/57; 700/279; 700/302

(58) Field of Classification Search ..... 702/151, 702/85, 92, 105, 107; 324/200–263; 246/473 R–473 A, 473.1, 473.2, 473.3, 111–113, 114 R, 246/114 A; 700/56, 57, 279, 280, 302
See application file for complete search history.

(56) References Cited

U.S. PATENT DOCUMENTS

| | | | | |
|---|---|---|---|---|
| 2,510,892 | A | 6/1950 | Kennelly | |
| 3,974,991 | A | 8/1976 | Geiger | |
| 4,290,607 | A | 9/1981 | McDonald | |
| 4,415,134 | A | 11/1983 | Wilson | |
| 5,178,349 | A | 1/1993 | Marengo | |
| 5,231,808 | A | 8/1993 | Angelette | |
| 5,415,369 | A | 5/1995 | Hungate | |
| 5,746,036 | A | 5/1998 | Angelette | |
| 6,399,875 | B1 | 6/2002 | Silvers | |
| 6,463,337 | B1 | 10/2002 | Walker | |
| 6,543,146 | B2 * | 4/2003 | Smith et al. | 33/356 |
| 6,586,671 | B1 | 7/2003 | Kelley et al. | |
| 6,734,575 | B2 | 5/2004 | Ricketts | |
| 6,963,202 | B2 | 11/2005 | Winkler et al. | |
| 6,987,460 | B2 * | 1/2006 | Tews et al. | 340/689 |
| 7,072,562 | B2 | 7/2006 | Domres et al. | |
| 7,147,189 | B2 | 12/2006 | Brown et al. | |
| 2004/0254727 | A1 * | 12/2004 | Ockerse et al. | 701/224 |
| 2005/0065726 | A1 * | 3/2005 | Meyer et al. | 701/213 |
| 2005/0237215 | A1 * | 10/2005 | Hatfield et al. | 340/686.2 |
| 2005/0284987 | A1 * | 12/2005 | Kande et al. | 246/125 |
| 2006/0017583 | A1 * | 1/2006 | Davenport et al. | 340/641 |

FOREIGN PATENT DOCUMENTS

| | | |
|---|---|---|
| DE | 828 706 | 2/1952 |

* cited by examiner

*Primary Examiner* — Mohamed Charioui
*Assistant Examiner* — Ricky Ngon
(74) *Attorney, Agent, or Firm* — Robert Wawrzyn, Esq.; Cian G. O'Brien, Esq.; Beusse Wolter Sanks Mora & Maire, P.A.

(57) ABSTRACT

A system is provided for aligning a railroad signal. The system includes at least one tilt device and at least one directional device to measure the respective tilt and direction of the railroad signal, and at least one controller coupled to the tilt device and the directional device. The controller is switchable between a calibration mode and a monitoring mode. Upon switching to the calibration mode, a correct tilt and correct direction of the railroad signal in a proper alignment is respectively measured and recorded in a memory of the controller. More particularly, upon recording the correct tilt and correct direction, the controller switches into the monitoring mode to determine if one of a measured tilt and a measured direction of the railroad signal exceeds a respective tilt threshold and direction threshold stored in the memory of the controller.

5 Claims, 7 Drawing Sheets

SYSTEM AND METHOD FOR ALIGNING A RAILROAD SIGNALING SYSTEM

FIELD OF THE INVENTION

The field of the present invention relates to railroad signaling systems generally, and more particularly, to a system, method and computer readable media for aligning a railroad signal for ease and clarity of viewing.

DESCRIPTION OF RELATED ART

Railroad signaling systems are used for various functions. For example, railroad signaling systems aligned with the roadway intersecting a railroad typically include railroad signals that flash red light along the roadway to warn drivers of automobiles and pedestrians of an oncoming train. As another example, railroad signaling systems positioned adjacent to and aligned with a railroad track typically support railroad signals (of green and red colors) which serve to warn a locomotive operator of an upcoming condition, such as a nearby locomotive, for example. The green and red colors may indicate safe and unsafe conditions, respectively. In either case, the railroad signals are typically positioned along various vertical, horizontal and diagonal bars of the railroad signaling system.

Railroad signaling systems depend on various factors for their effectiveness. One such factor includes proper alignment. For example, a railroad signal may become misaligned and not align with the roadway intersecting the railroad, thereby failing to provide the necessary warning to drivers and pedestrians of an upcoming train and creating a safety hazard. Such misalignment of a railroad signal may arise from one of several causes, such as being struck by a passing train, being struck by a passing vehicle such as a truck, harsh weather and wind, or vandalism. Additionally, railroad signals of railroad signaling systems aligned with the railroad are equally vulnerable to such misalignment, thereby failing to provide a necessary warning to a locomotive operator on an upcoming locomotive, or similar unsafe condition.

Current regulations require that a maintenance worker regularly travel to railroad signaling systems, and manually check each railroad signaling system for proper alignment. In some cases, the railroad signaling systems are extremely remote, and thus the cumulative high cost and inefficiency of such regular manual alignment checks is extensive.

Accordingly, it would be advantageous, both in terms of cost and time efficiency, to provide a system for automatically checking the alignment of railroad signaling systems, without requiring regular manual alignment checks, and arranging for any necessary alignment.

BRIEF DESCRIPTION OF THE INVENTION

In one embodiment of the present invention, a system is provided for aligning a railroad signal. The system includes a tilt device to measure the tilt of the railroad signal, a directional device to measure the direction of the railroad signal, and a controller coupled to the tilt device and the directional device.

In one embodiment of the present invention, a method is provided for aligning a railroad signal. The method includes providing a tilt device to measure the tilt of the railroad signal, providing a directional device to measure the direction of the railroad signal, and coupling a controller to the tilt device and the directional device.

In one embodiment of the present invention, computer readable media containing program instructions are provided for aligning a railroad signal. The computer readable media includes a computer program code to switch the controller to a calibration mode to measure a correct tilt and a correct direction of the railroad signal in a proper alignment by the tilt device and the directional device, and record the correct tilt and the correct direction in a memory of the controller. Additionally, the computer readable media further includes a computer program code for switching the controller from the calibration mode to a monitoring mode upon recording the correct tilt and the correct direction to determine if one of a measured tilt and a measured direction of the railroad signal exceeds a respective tilt threshold and direction threshold stored in the memory of the controller.

BRIEF DESCRIPTION OF THE DRAWINGS

A more particular description of embodiments of the invention briefly described above will be rendered by reference to specific embodiments thereof that are illustrated in the appended drawings, in which.

DETAILED DESCRIPTION OF THE INVENTION

Figure 1:
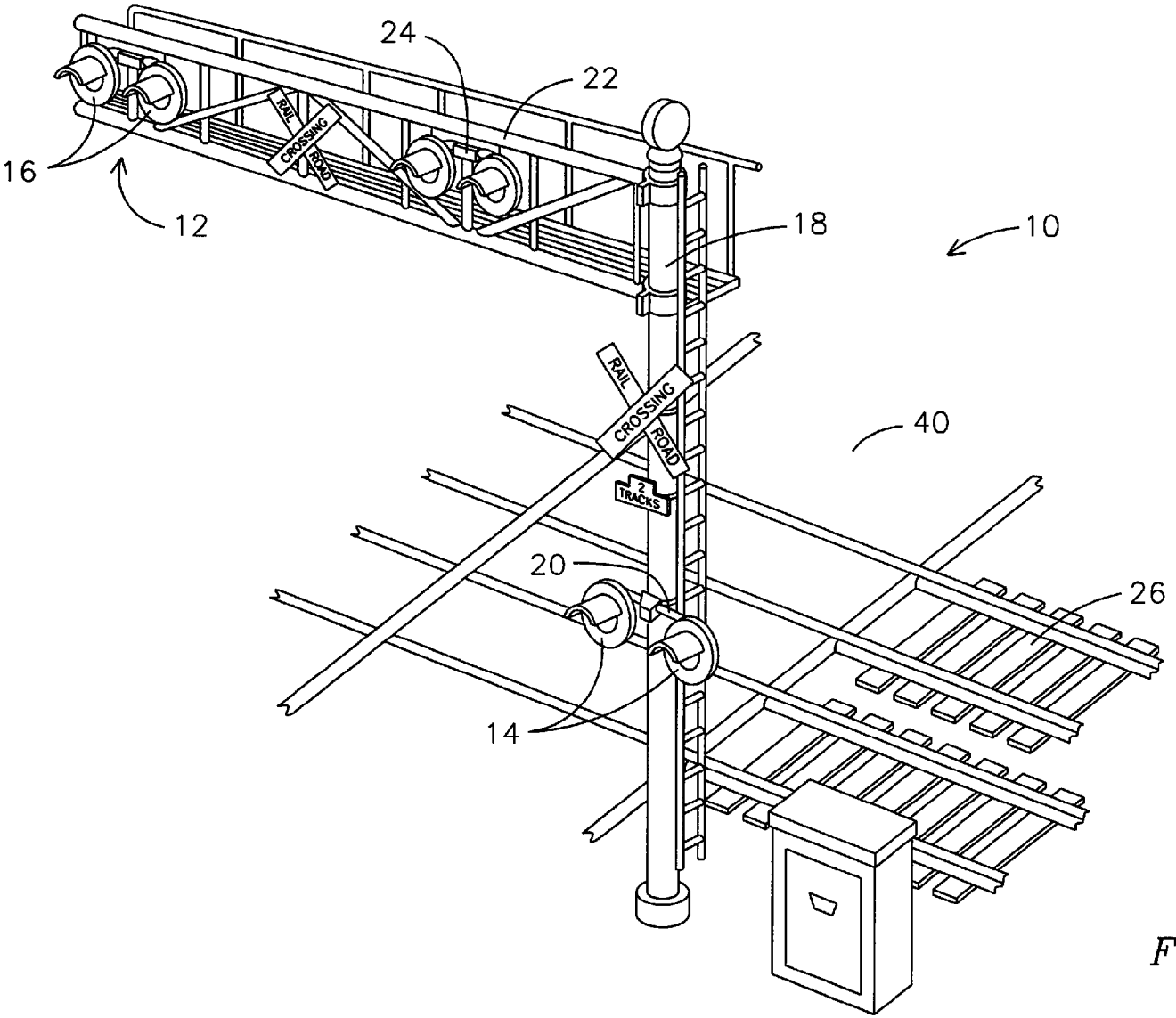
FIG. 1 is a perspective view of an embodiment of a system for aligning a railroad signal.

FIG. 1 illustrates an embodiment of a system 10 for aligning a railroad signal 14,16. A railroad signaling system 12 includes a plurality of railroad signals 14,16 coupled to a plurality of elongated members 18,20,22,24, such as a main vertical bar 18 and respective horizontal support bar 20 for holding a railroad signal 14, and a main horizontal bar 22 extending from the main vertical bar and respective horizontal support bar 24 for holding a railroad signal 16. The tilt and direction of the railroad signal 14,16 may be adjusted by correspondingly adjusting one of a cantilever, fulcrum, or other adjustment device that couples the horizontal support bars 20,24 to each respective railroad signal 14,16. Although FIG. 1 illustrates a main vertical bar 18 and main horizontal bar 20, the system 10 is not limited to aligning railroad signals for railroad signaling systems with this arrangement, and may be utilized with a main vertical bar without a main horizontal bar, a main horizontal bar without a main vertical bar, or any arrangement of elongated members supporting railroad signals. Additionally, although FIG. 1 illustrates a plurality of elongated members supporting a plurality of railroad signals, the system 10 may be utilized with a single elongated member or a single railroad signal, as appreciated by one of skill in the art.

Figure 3:
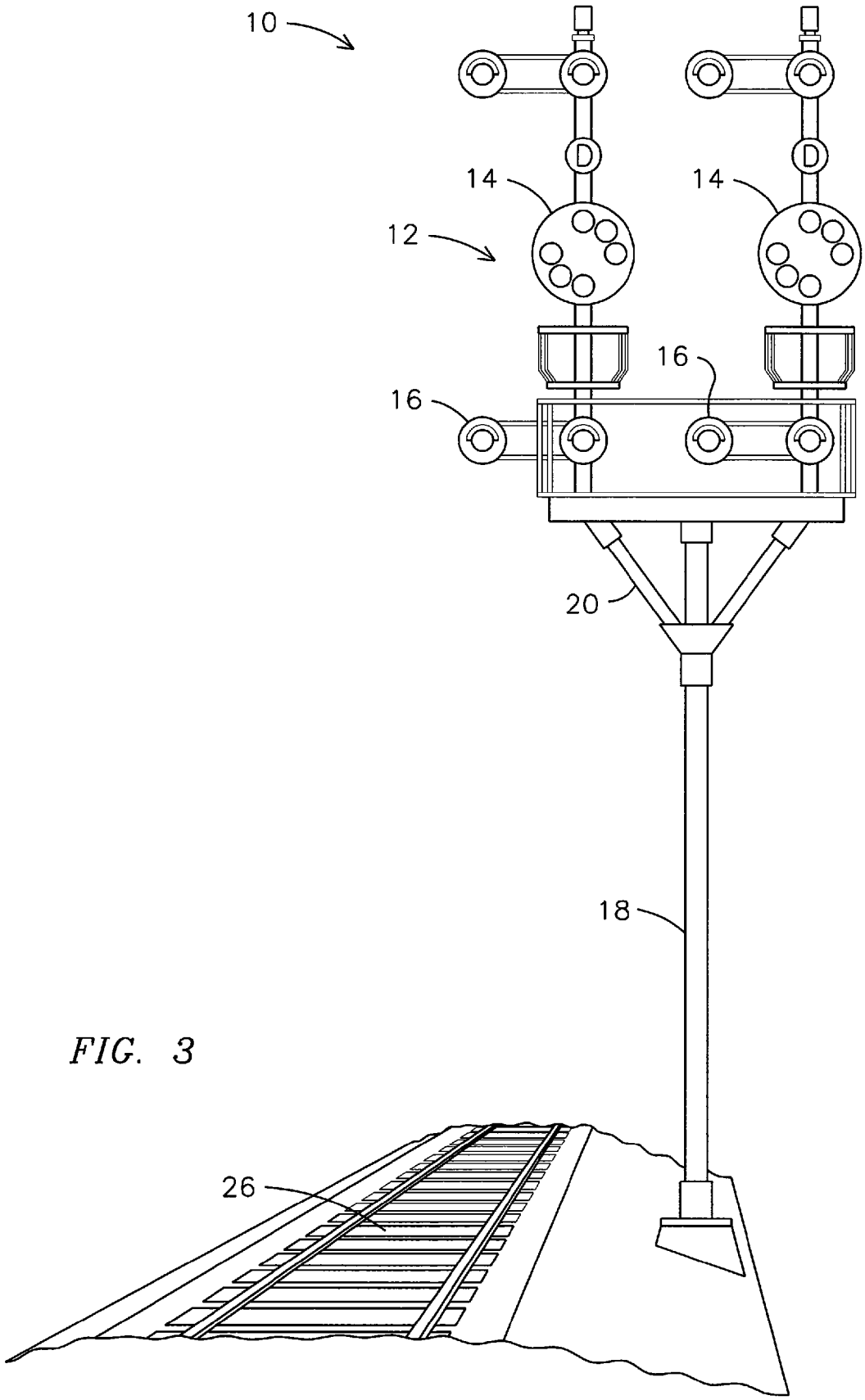
FIG. 3 is a perspective view of an embodiment of a system for aligning a railroad signal according to the present invention.

The system 10 may be used to align a variety of railroad signals 14,16. For example, the system 10 may be used to align railroad signals of a railroad signaling system, such as the railroad crossing signaling system 12 illustrated in FIG. 1, with the roadway 40. The system 10 may achieve a proper alignment such that pedestrians and drivers in cars on the roadway approaching the railroad 26 clearly see the railroad signals 14,16. Additionally, the system 10 may be used to align railroad signals of a railroad signaling system, such as the railroad signaling system 12 illustrated in FIG. 3, with the railroad 26 in a proper alignment such that operators of locomotives traveling along the railroad clearly see the railroad signals 14,16.

Figure 4:
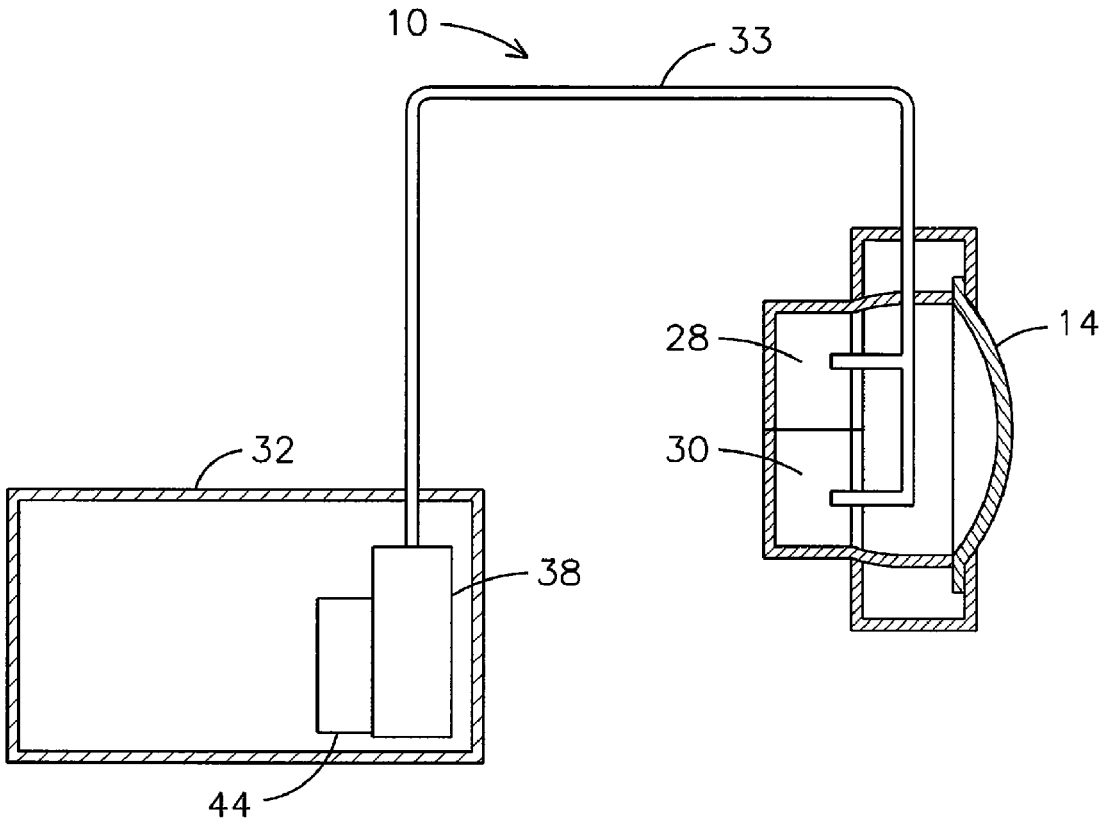
FIG. 4 is a partial side cross-sectional view of the embodiment of a system for aligning a railroad signal shown in FIG. 1.

As illustrated in FIGS. 1 and 4, the system 10 for aligning a railroad signal of a railroad signaling system further includes a tilt device 28 to measure the tilt of the railroad signal 14. The tilt device 28 may include any device capable of measuring the tilt of the railroad signal 14, such as an accelerometer, for example. In an exemplary embodiment of the system 10, a 3-axis DC-coupled accelerometer is used to measure the tilt of the railroad signal. The tilt device 28 may be positioned at the rear face of the railroad signal 14, as illustrated in FIG. 4, but may be placed at any location along the surface of the railroad signal provided it does not block the transmission of light. Although FIG. 4 illustrates a tilt device and directional device coupled to the railroad signal 14, a similar tilt device and directional device is similarly coupled to the railroad signal 16. Additionally, although FIGS. 1 and 4 illustrate a single tilt device 28 coupled to the railroad signal 14, a plurality of tilt devices may be coupled to the railroad signal.

Similarly, as illustrated in FIGS. 1 and 4, the system 10 for aligning a railroad signal of a railroad signaling system further includes a directional device 30 to measure the direction of the railroad signal 14. The directional device 30 may include any device capable of measuring the direction of the railroad signal, such a compass, for example. In an exemplary embodiment of the system 10, an electronic compass is used to measure the direction of the railroad signal. Although FIGS. 1 and 4 illustrate a single directional device 30 coupled to the railroad signal 14, a plurality of directional devices may be coupled to the railroad signal.

Figure 2:
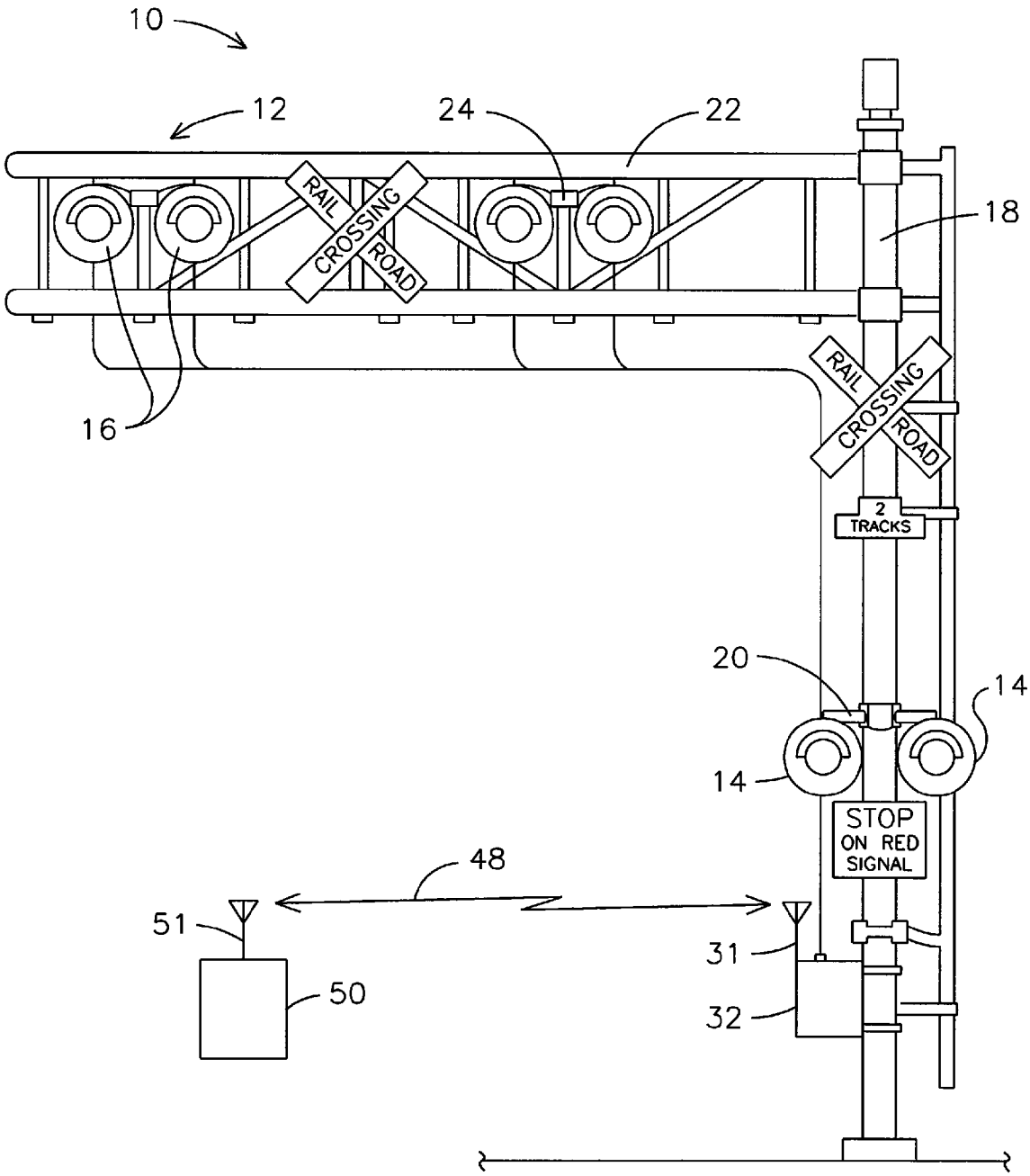
FIG. 2 is a front view of the embodiment of a system for aligning a railroad signal shown in FIG. 1.

As illustrated in FIGS. 2 and 4, the system 10 for aligning a railroad signal of a railroad signaling system further includes a controller 32 coupled to each tilt device 28 and each directional device 30. As illustrated in the exemplary embodiment of FIG. 4, each controller 32 is coupled to each tilt device 28 and directional device 30 by a wire coupling 33 to accommodate transmission of data, as discussed below. Although FIG. 2 illustrates the controller 32 positioned at the base of the main vertical bar 18, the controller may be positioned at any location along the railroad signaling system 12, including at any location along each elongated member. Additionally, although FIG. 2 illustrates a single controller 32 coupled to all railroad signals 14,16, an individual controller may be positioned adjacent to the railroad signal and individually coupled to each respective tilt device and positional device. Although FIG. 4 illustrates the tilt device 28 and directional device 30 coupled to the controller 32 via a wire coupling 33, the tilt device and directional device may be wirelessly coupled to the controller, such as via transceivers, for example, or any other mode of communication appreciated by one of skill in the art.

In the exemplary embodiment illustrated in FIG. 2, the controller 32 and remote terminal 50 may wirelessly communicate an alert signal 48 via transceivers 31,51 respectively positioned on the controller and remote terminal 50, or by any other method of communication appreciated by one of skill in the art.

Each controller 32 is switchable between a calibration mode and a monitoring mode. The controller 32 may be switched between modes manually using a manual switch when a worker visits the railroad signaling system to align the railroad signals, or it may be switched between modes using an automatic switch and automatic steps for performing calibration. Additionally, the controller 32 may be switched between modes by receiving a signal over a wired or wireless network, for example.

Figure 5:
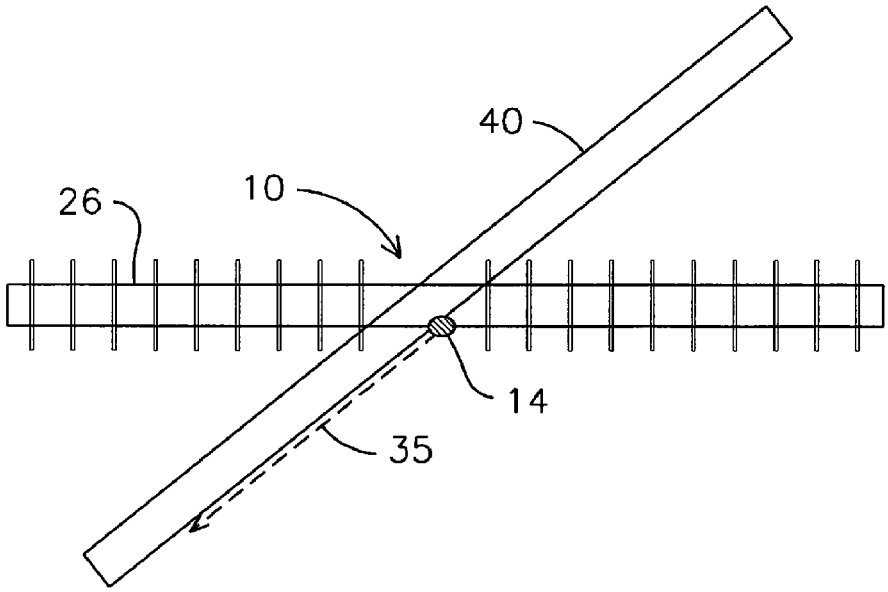
FIG. 5 is a top view of an embodiment of a system for aligning a railroad signal according to the present invention.

Upon switching the controller 32 into the calibration mode, the railroad signal 14,16 is aligned in a proper alignment for which the railroad signal performs a safe operation. For example, a proper alignment of the railroad signal 14 of FIG. 1 includes aligning the railroad signal 14 along the roadway 40 such that drivers in automobiles on the roadway and pedestrians on the roadway approaching the railroad 26 clearly see the railroad signal 14. In an exemplary embodiment of the system 10, a proper alignment of the railroad signal 14 includes aligning the railroad signal 14 with the roadway 40 such that the direction of the railroad crossing signal does not diverge with respect to the roadway, and the tilt of the railroad crossing signal ensures that the railroad crossing signal is substantially parallel with the plane of the roadway. Upon aligning the railroad signal 14,16 in a safe alignment, including a correct tilt 37 (FIG. 7) and correct direction 35 (FIG. 5), the tilt device 28 and directional device 30 respectively measure each correct tilt and correct direction, and communicate the correct tilt and correct direction to the memory 38 of the controller 32 via the wire coupling 33. Each correct tilt 37 and correct direction 35 is recorded in the memory 38 of the controller 32 upon receiving each piece of data from the tilt device 28 and directional device 30. In an exemplary embodiment of the system 10, a 3-axis DC-coupled accelerometer 28 is utilized for the tilt device and an electronic compass 30 is utilized for the directional device. The correct tilt 37 and correct direction 35 of the railroad signal 14,16 is recorded in the memory 38 of each controller 32 and respectively includes the three vector components of the gravitational pull on the railroad signal 14,16 in three dimensions and an angular direction of the railroad signal 14,16. Upon recording the correct tilt 37 and the correct direction 35 in the memory 38 of each controller 32, each controller switches out of the calibration mode into the monitoring mode. When operating in the monitoring mode, the controller 32 regularly samples measured tilt and measured direction of the railroad signal 14,16 from the tilt device 28 and directional device 30 via the wire coupling 33. The controller 32 may sample the measured tilt and measured direction data of the railroad signal 14,16 from the tilt device 28 and directional device 30 at an adjustable sample rate.

For each measured tilt and measured direction communicated from the tilt device 28 and directional device 30 to the controller 32, the controller determines if one of the measured tilt and a measured direction exceeds a respective tilt threshold and direction threshold stored in the memory 38 of the controller. To determine if the measured tilt or measured direction of the railroad signal 14,16 exceeds a respective tilt threshold or direction threshold, each controller 32 detects the presence of a mean shift over a time duration of one of tilt and direction. In an exemplary embodiment of the system 10, a tilt mean shift over a time duration includes a shift of the tilt vector mean of the railroad signal 14,16 in three dimensions as measured by the DC-coupled accelerometer 28 beyond the respective three dimensions of the tilt threshold. In an exemplary embodiment of the system 10, a directional mean shift over a time duration includes a shift of the vector mean of the railroad signal 14,16 angular direction as measured by the electronic compass 30 beyond a respective angular direction threshold. In detecting the presence of a mean shift over a time duration of one of tilt and direction, the controller 32 negates transient vibrations of the railroad signal 14,16 during the time vibration. The time duration is thus set to be long enough to avoid consideration of such transient vibrations, yet short enough to provide meaningful calculations of each tilt mean shift and direction mean shift at each time.

In an exemplary embodiment of the system 10, when the controller 32 switches into the monitoring mode, the controller determines whether one of a measured tilt and measured direction of the railroad signal 14,16 exceeds a respective tilt threshold and direction threshold by collecting the measured tilt data and the measured direction data, and processing the measured tilt data and the measured direction data with an error detection filter 44. The data output from this filtering process indicates whether the measured tilt data and the measured direction data respectively exceed the tilt threshold and the direction threshold.

Railroad signaling systems are commonly located at the intersection of roadways and railroads, as discussed above. The intersection of roadways and railroads have various arrangements, each of which present unique challenges to correctly aligning the railroad signals of the railroad signaling systems positioned at the intersection. For example, some roadways intersect railroads at a non-orthogonal angle, and thus require calibration to a correct direction with that non-orthogonal angle. As another example, some roadways intersect railroads at an inclined angle, instead of a common leveled-roadway. Such roadways thus require calibration to a correct tilt with the inclined angle of the roadway, for example.

Figure 6:
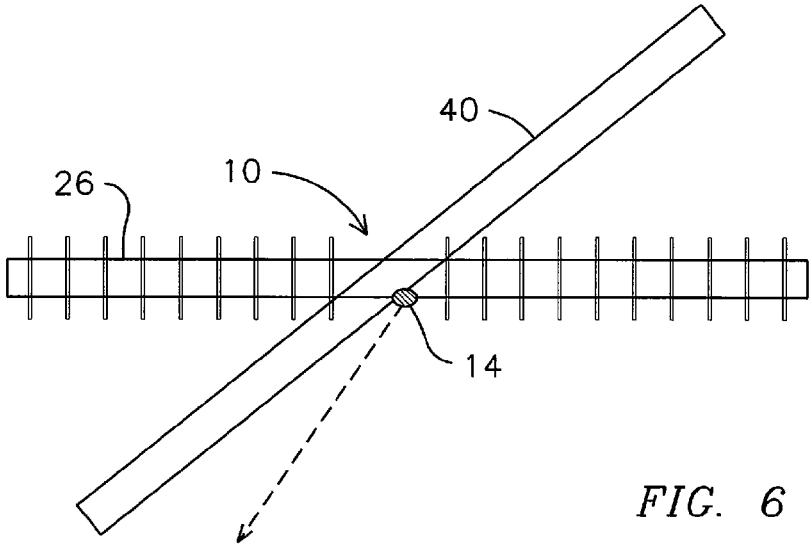
FIG. 6 is a top view of an embodiment of a system for aligning a railroad signal according to the present invention.

Upon detecting that either the measured tilt or measured direction from the respective tilt device 28 and direction device 30 exceeds a respective tilt threshold and direction threshold, the controller 32 switches from the monitoring mode into an alert mode. In an exemplary embodiment of the system 10 illustrated in FIGS. 5 and 6, the controller 32 is initially switched to the calibration mode prior to the monitoring and alert modes and the railroad signal 14 is aligned with a correct direction 35 along the roadway 40. In the exemplary embodiment of FIGS. 5 and 6, the roadway 40 makes a non-orthogonal angle with the railroad 26, however the roadway may make a substantially orthogonal angle with the railroad. The railroad signal 14 may subsequently be rotated beyond the direction threshold and become misaligned, as illustrated in FIG. 6, due to a number of reasons, including contact with a passing locomotive, contact with passing automobiles and trucks, and vandalism, among other reasons. In FIG. 6, the direction of the railroad signal 14 has changed but the tilt of the railroad signal (in the plane of the figure) remains unchanged. The direction device 30 measures the misaligned direction of the railroad signal 14 and communicates the measured direction data to the controller 32, which detects that the mean of the railroad signal direction has shifted beyond the direction threshold. Hence, controller 32 switches from the monitoring mode into an alert mode upon the railroad signal 14 rotating to vary the measured direction beyond the direction threshold, despite that the railroad signal 14 does not tilt to vary the measured tilt beyond the tilt threshold.

Figure 7:
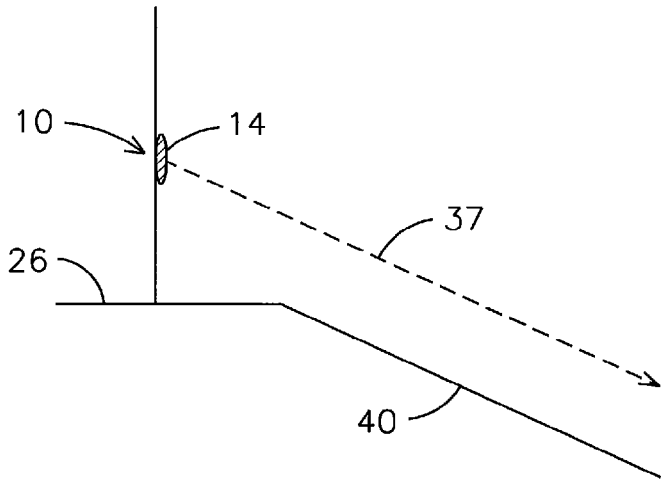
FIG. 7 is a side view of an embodiment of a system for aligning a railroad signal according to the present invention.
Figure 8:
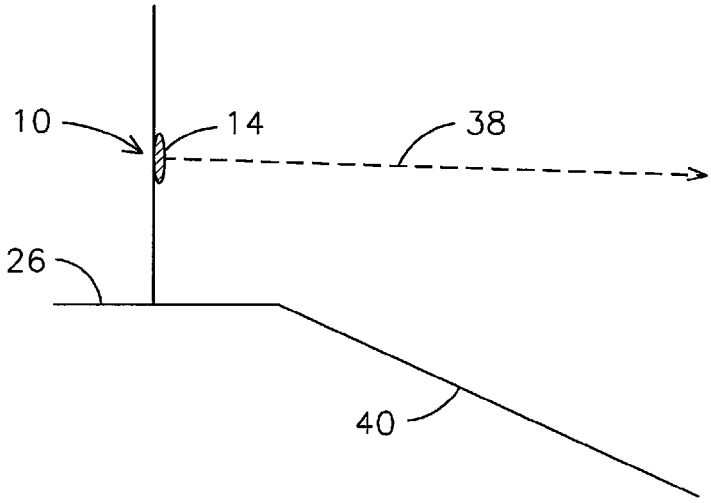
FIG. 8 is a side view of an embodiment of a system for aligning a railroad signal according to the present invention.

In the exemplary embodiment of FIGS. 7 and 8, the roadway 40 may rise at an uphill incline to the railroad 26, however the roadway may lower at an incline to the railroad or approach the railroad from a substantially level angle. In the exemplary embodiment of FIGS. 7 and 8, the controller 32 is first switched to the calibration mode and the railroad signal 14 is aligned with a correct tilt 37 with the roadway 40. The railroad signal 14 may be subsequently tilted beyond the tilt threshold, as illustrated in FIG. 8, due to a number of reasons, including contact with a passing locomotive, contact with passing automobiles and trucks, and vandalism, among other reasons. In FIG. 8, the tilt of the railroad signal 14 has changed to an incorrect tilt 38 but the direction of the railroad signal (in the plane of the figure) remains unchanged. The tilt device 28 measures the tilt of the railroad signal 14 and communicates the measured tilt data to the controller 32, which detects that the mean of the railroad signal tilt has shifted beyond the tilt threshold. Hence, controller 32 switches from the monitoring mode into an alert mode upon the railroad signal 14 tilting to vary the measured tilt beyond the tilt threshold, despite that the railroad signal 14 does not rotate to vary the measured direction beyond the direction threshold.

In the illustrated embodiment of the system 10 of FIG. 2 and FIGS. 5-8, upon each controller 32 switching into the alert mode, each controller may send an alert signal 48 to a remote terminal 50 to request realignment of the railroad signal 14,16 to the proper alignment with the correct direction 35 and correct tilt 37. In an exemplary embodiment of the system 10, upon the remote terminal 50 receiving an alert signal 48, an operator of the remote terminal may arrange to dispatch a maintenance worker to realign the railroad signal 14,16 by adjusting the tilt and direction of the railroad signal to achieve a correct direction 35 and correct tilt 37. In an exemplary embodiment of the system 10, such a maintenance worker may adjust the tilt and direction of the railroad signal 14,16 using at least one of a fulcrum and cantilever coupling the railroad signal to each elongated member 18,20,22,24.

Figure 9:
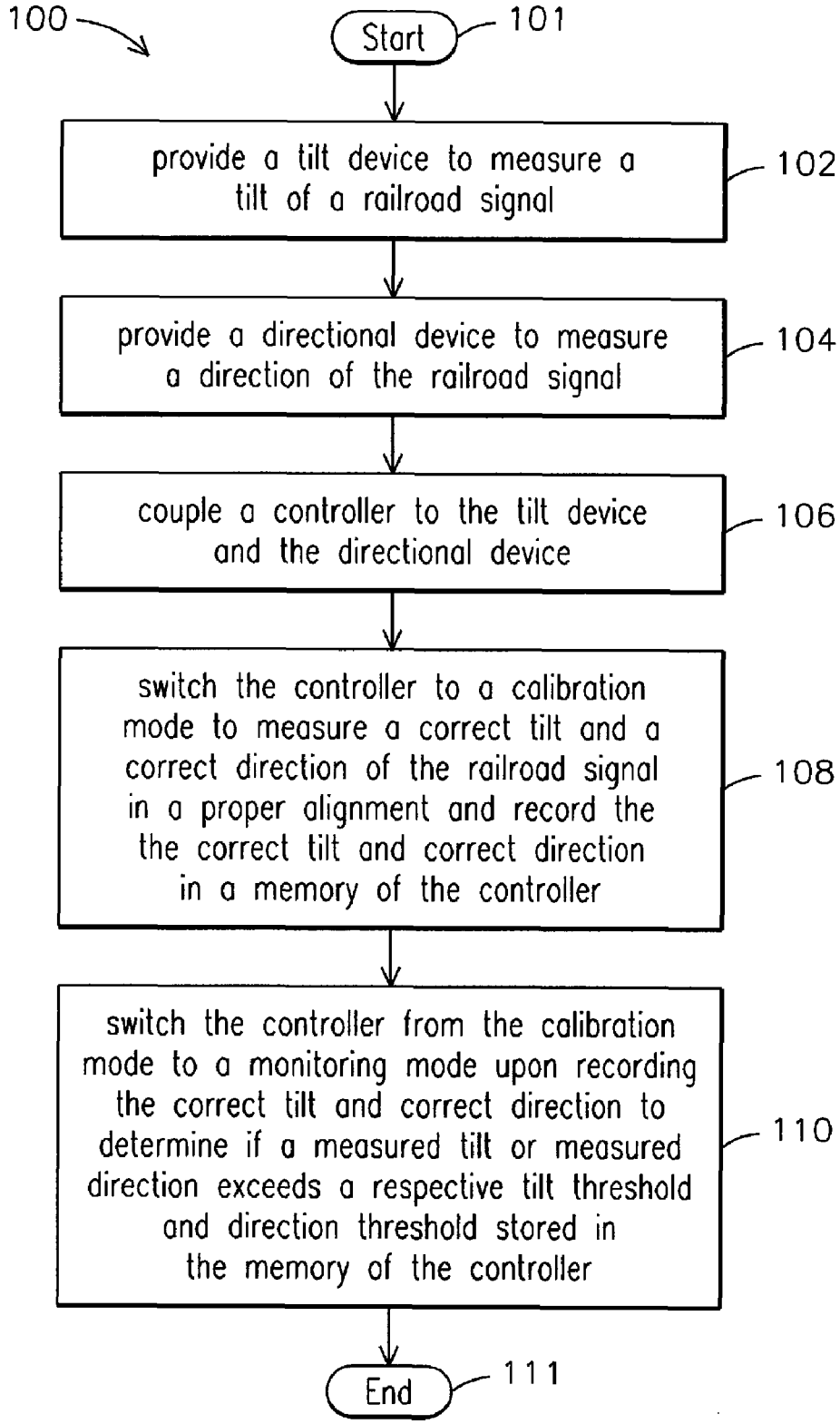
FIG. 9 is a flow chart illustrating an exemplary embodiment of a method of operating the system illustrated in FIG. 1.

FIG. 9 illustrates a method 100 for aligning a railroad signaling system 12. As illustrated in the flow chart of FIG. 9, the method 100 begins at block 101 by providing (block 102) a tilt device 28 to measure the tilt of the railroad signal 14,16, followed by providing (block 104) a directional device 30 to measure the direction of the railroad signal 14,16. Subsequently, the method 100 includes coupling (block 106) a controller 32 to each tilt device 28 and each directional device 30. As stated above, one controller may be coupled to all tilt devices and directional devices, as illustrated in FIG. 2, or an individual controller may be respectively coupled to each tilt device and directional device.

Upon coupling a controller 32 to each tilt device 28 and directional device 30, the method may further include switching (block 108) a controller 32 to a calibration mode to measure a correct tilt 37 and a correct direction 35 of the railroad signal 14,16 in a proper alignment by each tilt device 28 and each directional device 30, and record the correct tilt 37 and the correct direction 35 in a memory 38 of each controller 32. The method 100 subsequently involves switching (block 110) each controller 32 from the calibration mode to a monitoring mode upon recording the correct tilt 37 and the correct direction 35 to determine if a measured tilt or a measured direction of the railroad signal 14,16 exceeds a respective tilt threshold and direction threshold stored in the memory 38 of the controller 32.

Figure 10:
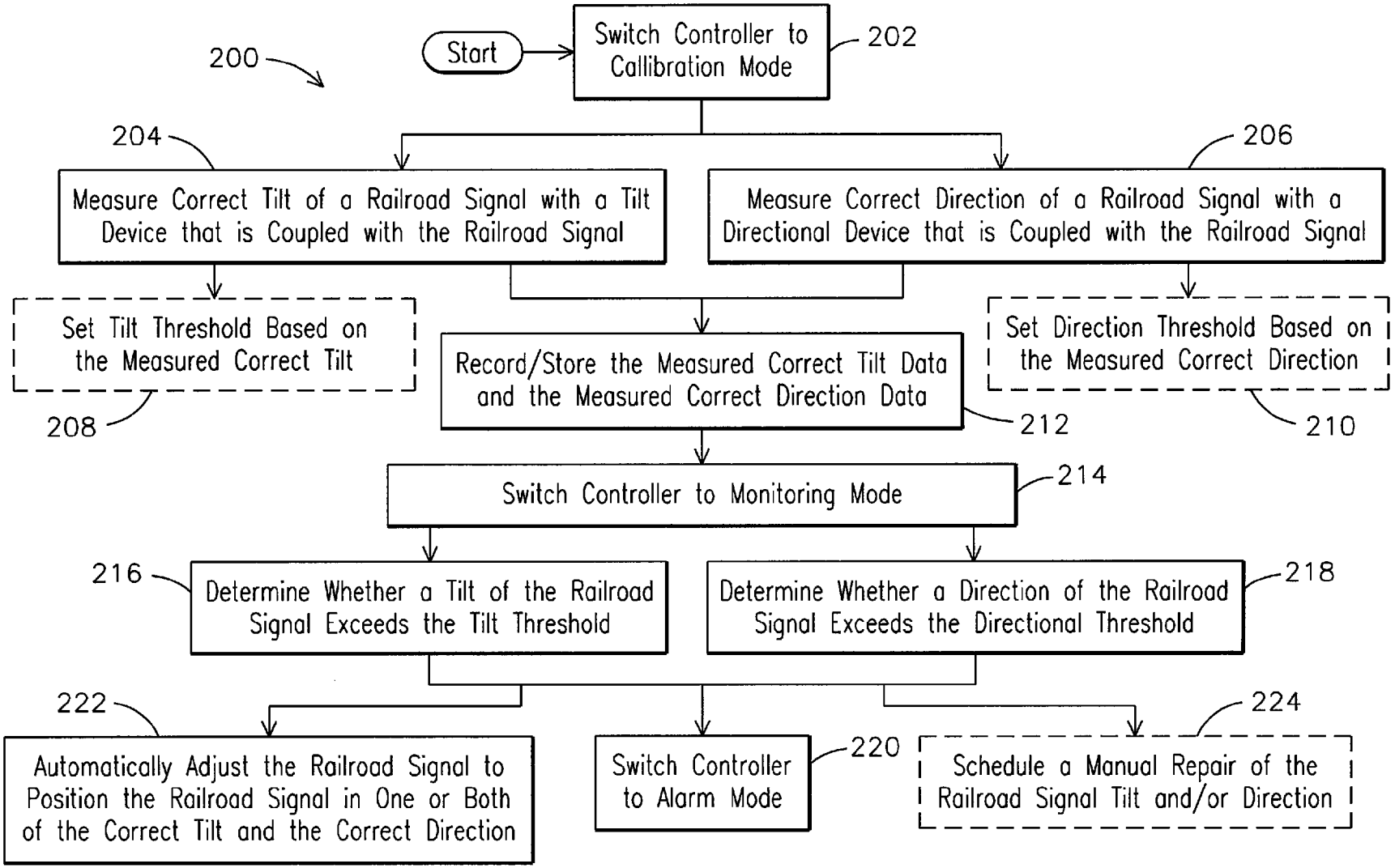
FIG. 10 is a flow chart illustrating an exemplary embodiment of a method of operating a system for aligning a railroad signal.

FIG. 10 illustrates a method 200 for aligning a railroad signal 12. As illustrated in the flow chart of FIG. 10, the method 200 includes switching (block 202) a controller 32 into a calibration mode. After switching the controller 32 into a calibration mode, the method 200 includes measuring (block 204) a correct tilt 37 of the railroad signal 14 with a tilt device 28 coupled to the railroad signal 14, and measuring (block 206) a correct direction 35 of a railroad signal with a direction device 30. Upon respectively measuring the correct tilt and correct direction 37,35 of the railroad signal 14, the method may include setting (block 208) a tilt threshold or setting (block 210) a direction threshold based on the respective correct tilt and correct direction. Upon measuring the correct tilt and correct direction 37,35, the method includes recording (block 212) the correct tilt and correct direction 37,35 in a memory of the controller 32.

As illustrated in the exemplary method embodiment of FIG. 10, upon recording the correct tilt and correct direction 37,35 in a memory of the controller 32, the method 200 may include switching (block 214) the controller 32 into a monitoring mode. Upon switching the controller 32 into the monitoring mode, the method 200 includes determining (block 216) whether a measured tilt of the railroad signal 14 exceeds a tilt threshold stored in the memory of the controller 32, and the method further includes determining (block 218) whether a measured direction of the railroad signal 14 exceeds a direction threshold stored in the memory of the controller 32. Upon determining whether a measured tilt or measured direction of the railroad signal 14 exceeds a respective tilt threshold or direction threshold, the method 200 may include switching (block 220) the controller 32 into an alert mode to output an alert signal, automatically adjusting (block 222) the railroad signal to position the railroad signal in one or both of the correct tilt and the correct direction and scheduling (block 224) a manual repair of the railroad signal tilt and/or direction.

Based on the foregoing specification, one or more of the above-discussed embodiments of the invention may be implemented using computer programming or engineering techniques that include computer software, firmware, hardware or any combination or subset thereof, wherein the technical effect is to align a railroad signal so that it can be easily and clearly seen by operators of locomotives and/or automobiles. Any such resulting program, having computer-readable code means, may be embodied or provided within one or more computer-readable media, thereby making a computer program product, i.e., an article of manufacture, according to the discussed embodiments of the invention. The computer readable media may be, for instance, a fixed (hard) drive, diskette, optical disk, magnetic tape, semiconductor memory such as read-only memory (ROM), etc., or any transmitting/receiving medium such as the Internet or other communication network or link. The article of manufacture containing the computer code may be made and/or used by executing the code directly from one medium, by copying the code from one medium to another medium, or by transmitting the code over a network.

One skilled in the art of computer science will easily be able to combine the software created as described with appropriate general purpose or special purpose computer hardware, such as a microprocessor, to create a computer system or computer sub-system of the method embodiment of the invention. An apparatus for making, using or selling embodiments of the invention may be one or more processing systems including, but not limited to, a central processing unit (CPU), memory, storage devices, communication links and devices, servers, I/O devices, or any sub-components of one or more processing systems, including software, firmware, hardware or any combination or subset thereof, which embody those discussed embodiments the invention.

This written description uses examples to disclose embodiments of the invention, including the best mode, and also to enable any person skilled in the art to make and use the embodiments of the invention. The patentable scope of the embodiments of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for aligning a railroad signal, said method comprising:

switching a controller into a calibration mode;

measuring a correct tilt of the railroad signal in a proper alignment to obtain a measured correct tilt;

measuring a correct direction of said railroad signal in the proper alignment to obtain a measured correct direction;

switching said controller from said calibration mode to a monitoring mode;

measuring a tilt of said railroad signal to obtain a measured tilt;

measuring a direction of said railroad signal to obtain a measured direction; and determining if one of a measured tilt and a measured direction of the railroad signal exceed a respective tilt threshold and direction threshold stored in the memory of the controller; and detecting a presence of a mean shift over a time duration of one of said tilt and direction, which mean shift negates transient vibrations of the railroad signal during said time duration.

2. The method of claim 1, further comprising:

recording said measured correct tilt and said measured correct direction in a memory of said controller.

3. The method of claim 1, further comprising one of:

switching the controller into one of an alarm mode;

adjusting the railroad signal to position the railroad signal with at least one of said correct tilt and said correct direction; and scheduling a manual repair of at least one of the tilt and direction of said railroad signal.

4. The method of claim 1, wherein said measured correct tilt comprises three vector components of the gravitational pull in three dimensions on the railroad signal.

5. The method of claim 1, wherein said measured correct direction comprises an angular direction of the railroad signal.

* * * * *